United States Patent [19]

Baron et al.

[11] 4,398,592

[45] Aug. 16, 1983

[54] BASKET RETAINER FOR HEAT EXCHANGER TUBE CLEANING ELEMENT

[75] Inventors: Walter J. Baron; Laird C. Cleaver, both of Milwaukee, Wis.

[73] Assignee: Water Services of America, Inc., Milwaukee, Wis.

[21] Appl. No.: 350,286

[22] Filed: Feb. 18, 1982

[51] Int. Cl.[3] ..... F28G 1/12; F28G 15/02

[52] U.S. Cl. ..... 165/95; 15/3.51

[58] Field of Search ..... 165/95; 15/3.51

[56] References Cited

U.S. PATENT DOCUMENTS

| | | | |
|---|---|---|---|
| 3,319,710 | 5/1967 | Heeren et al. | 165/95 |
| 4,124,065 | 11/1978 | Leitner et al. | 165/95 |
| 4,353,414 | 10/1982 | Leitner | 165/95 |

*Primary Examiner*—Sheldon J. Richter

*Attorney, Agent, or Firm*—Andrus, Sceales, Starke & Sawall

[57] ABSTRACT

A heat exchanger has a plurality of fluid flow tubes secured adjacent their ends by tube sheets. Cleaning elements are adapted to shuttle back and forth in the tubes and are adapted to be captured by baskets. A basket retaining plate is fixedly mounted, as by bolts or the like, in spaced relationship outwardly from the outer tube sheet face. The plate and its mount cooperate with the tube sheet to hold the baskets in fixed position relative to the tube sheet and tube ends. The outer capturing and holding portions of the baskets extend outwardly from the retaining plate. The baskets include central or intermediate portions which extend through openings in the plate and inner portions which extend through the space between the plate and tube sheet and which terminate within the tube sheet openings. The baskets are fixedly secured against transverse shifting by a two-point support, one at the inner basket ends and one intermediate their ends. To hold the baskets in longitudinally fixed position, and in one embodiment, the basket intermediate portions are threaded to the retaining plate. In another embodiment, shoulders adjacent the inner basket ends engage the plate and tube sheet. The retaining plate is of lesser diameter than the tube sheet and is provided with unobstructed fluid flow openings between the baskets and basket-receiving openings.

11 Claims, 4 Drawing Figures

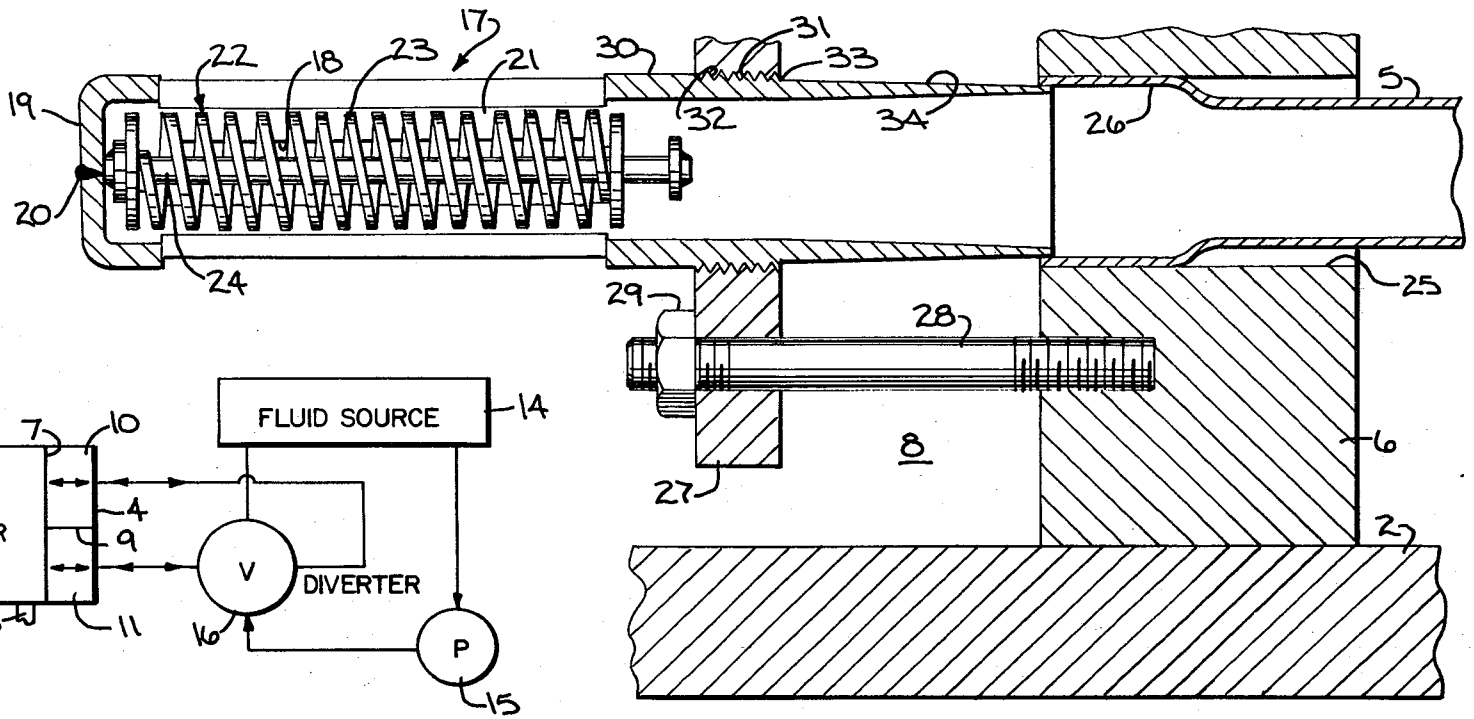
FIG.3
FIG.1
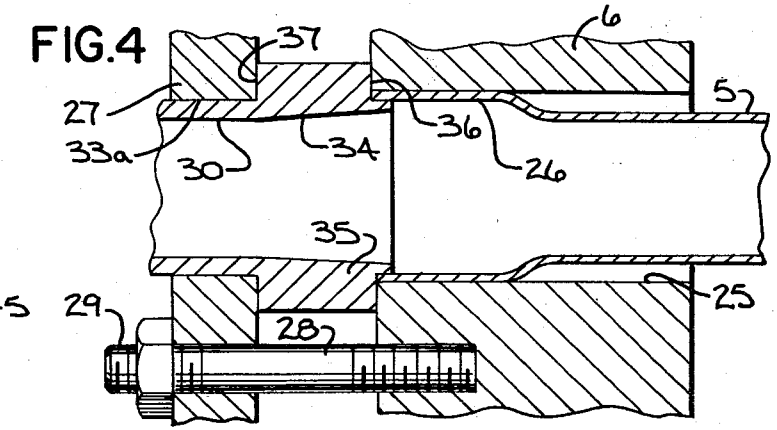
FIG.4
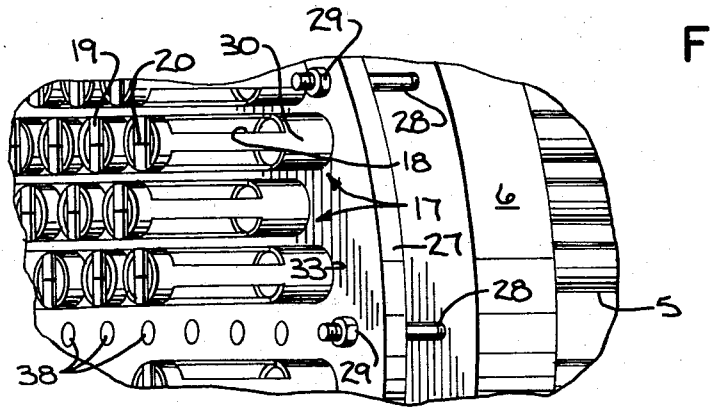
FIG.2

BASKET RETAINER FOR HEAT EXCHANGER TUBE CLEANING ELEMENT

| U.S. PRIOR ART OF INTEREST | | |
|---|---|---|
| U.S. Pat. No. | Inventor | Issued |
| 3,319,710 | Heeren et al. | May 16, 1967 |
| 4,124,065 | Leitner et al. | Nov. 7, 1978 |

BACKGROUND AND SUMMARY OF THE INVENTION

This invention relates to shuttle cleaning of heat exchanger tubes and is an improvement over the concepts disclosed in the above-identified patents.

It is known from the above-identified patents to connect individual elongated cleaning element capturing cages or baskets to both ends of longitudinally extending tubes disposed in a heat exchanger housing. The tube ends are held in position at both ends by transverse tube sheets. The baskets are adapted to contain shuttlable cleaning elements, such as brushes. Fluid flowing in one direction through the tubes keeps the cleaning elements captured within their respective basket chambers, while the fluid discharges outwardly through slot-like openings in the basket walls. Upon reversal of fluid flow, the cleaning elements are forced out of their baskets and through the tubes to the baskets at the opposite tube ends to thereby perform a tube cleaning action.

Several ways have been suggested to mount the baskets in fluid flow communication with the tubes, which enter openings in the tube sheets. The inner basket ends have been press fit into the openings or into the tube ends themselves.

The present inventors' co-pending U.S. patent application Ser. No. 350,288, Filed Feb. 18, 1982 and entitled "Mounting For Heat Exchanger Tube Cleaner Capturing Devices" discloses another arrangement where the inner basket ends are provided with a collar which hangs from a flared lip on the tube end which is disposed beyond the outer tube sheet face.

In some instances, the above-mentioned basket mounting arrangements may be undesirable. For example, in high temperature heat exchanger applications, a sole press fit connection may not hold due to large temperature fluctuations to which the joint is subjected. In other instances, the specifications for the particular heat exchanger may call for unthreaded tube sheet openings or unflared tube ends, or other structure incompatible with previous mounts.

It is a task of the present invention to provide a mounting means for the cleaning element capturing baskets which does not depend solely on the aforementioned methods of connection but which nevertheless holds the baskets securely in place.

In accordance with the various aspects of the invention, a basket retaining plate is fixedly mounted, as by bolts or the like, in spaced relationship outwardly from the outer tube sheet face. The plate and its mount cooperate with the tube sheet to hold the baskets in fixed position relative to the tube sheet and tube ends, regardless of temperature changes. The outer capturing and holding portions of the baskets extend outwardly from the retaining plate. The baskets include central or intermediate portions which extend through openings in the plate and inner portions which extend through the space between the plate and tube sheet and which terminate within the tube sheet openings. The baskets are fixedly secured against transverse shifting by a two-point support, one at the inner basket ends and one intermediate their ends. To hold the baskets in longitudinally fixed position, and in one embodiment, the basket intermediate portions are threaded to the retaining plate. In another embodiment, shoulders adjacent the inner basket ends engage the plate and tube sheet. The retaining plate is of lesser diameter than the tube sheet and is provided with unobstructed fluid flow openings between the baskets and basket-receiving openings.

BRIEF DESCRIPTION OF THE DRAWINGS

The accompanying drawings illustrate the best mode presently contemplated by the inventors for carrying out the invention.

In the drawings:

FIG. 1 is a schematic showing of a heat exchanger and fluid flow controls therefor;

FIG. 2 is a fragmentary perspective view of a portion of the heat exchanger interior and showing the tube sheet and retaining plate;

FIG. 3 is a longitudinal section showing one embodiment of basket mount; and

FIG. 4 is a longitudinal section showing another embodiment of basket mount.

DESCRIPTION OF THE PREFERRED EMBODIMENT

The present invention is directed to tube-type heat exchangers. A schematic showing of such an exchanger and its fluid flow controls is shown in FIG. 1. The exchanger 1 comprises a cylindrical housing 2 having end closure heads 3 and 4, and a plurality of longitudinally extending tubes 5 therein. The exposed open ends of tubes 5 are connected to circular transverse tube sheets 6 and 7 which are spaced from the respective end heads 3 and 4. Head 3 and tube sheet 6 form one fluid flow chamber 8, while a partition 9 separates the space between head 4 and tube sheet 7 into a pair of fluid flow chambers 10 and 11. Heat exchanging fluid is introduced through an inlet 12 to the area around tubes 5 and discharges through an outlet 13.

Heat exchanger 1 is also connected to a fluid source 14, a pump 15 and a fluid diverter valve 16 by various conduits in the conventional manner. Fluid is directed through tubes 5 via chambers 10, 8 and 11, in that order or in reverse order, depending on the position of valve 16.

Heat exchanger 1 is provided with tube cleaning means. For this purpose, the ends of each tube 5 are connected to a capturing device which in the present embodiment comprises a longitudinally extending elongated slotted basket 17 which is coaxial with the tube and made of metal or other suitable material. The basket is slotted at 18. The inside diameters of tube 5 and basket 17 are about the same. The outer end of each basket 17 is provided with a pair of narrow tabs 19 which are folded over and joined, as by a weld 20, to form an abutment.

Each basket forms a capturing chamber 21 for holding a tube cleaning device 22 which is adapted to shuttle back and forth between end baskets within its respective tube 5 upon reversal of fluid flow by valve 16. Device 22 may be of any desired type, that shown having a coil spring 23 shiftable along a central rod 24.

In the present embodiment, each tube 5 is shown as entering an opening 25 in tube sheet 6 and having an enlarged end portion 26 which fits tightly within the outer end of the opening.

In accordance with the various aspects of the invention, and referring to FIGS. 2 and 3, a generally circular transverse retaining plate 27 is disposed outwardly in spaced relationship from and generally parallel to tube sheet 6 within chamber 8. Means are provided to fixedly secure retaining plate 27 relative to tube sheet 6. For this purpose, and in the present embodiment, a plurality of circumferentially spaced bolts 28 threadably extend through plate 27 and into threaded engagement within tube sheet 6. Nuts 29 on the outer threaded bolt ends serve to lock plate 27 in position on the bolts. The longitudinal spacing between plate 27 and tube sheet 6 may be changed by adjusting the bolts.

The mounted plate 27 cooperates with tube sheet 6 to hold each basket 17 in position relative to tube sheet 6 and the end of tube 5. As shown, basket 17 has a generally cylindrical wall 30 with the outer cleaning element holding portion thereof containing slots 18 and extending outwardly beyond retaining plate 27. The intermediate basket wall portion is provided with external threads 31 which threadably engage internal threads 32 on an opening 33 in retaining plate 27. The inner basket wall portion extends inwardly from plate 27 toward tube sheet 6 and terminates within tube sheet opening 25. This inner wall portion is shown as being tapered, as at 34. In the present instance, the inner basket end telescopes slightly into and engages enlarged tube portion 26 in a press fit.

Basket 17 is fixedly secured against transverse shifting by virtue of its two-point support, i.e., the tube sheet 6 and tube 5 at its inner end, and retaining plate 27 intermediate its ends.

Basket 17 is also fixedly secured against longitudinal shifting by virtue of the threaded connections by bolts 28 of tube sheet 6 and plate 27, and in FIG. 3, the threaded passage of basket 17 through plate 27.

FIG. 4 discloses another form of means to prevent longitudinal shifting of the basket. In this instance, there is no threaded connection between basket 17 and the opening 33*a* in retaining plate 27, the basket merely being slideable therethrough. Instead, the inner end portion of wall 30 is provided with an annular spacer 35 thereon which is larger than openings 25 and 33 and which form spaced inner and outer shoulders 36 and 37 which engage the respective tube sheet 6 and plate 27 when bolts 28 are tightened up.

It is, of course, clear that there will be a plurality of openings 33, 33*a* in retaining plate 27 and which are disposed in axial alignment with openings 25 in tube sheet 6.

It is desirable that, during operation of heat exchanger 1, there be an adequate lateral flow of fluid in chamber 8 between tube sheet 6 and retaining plate 27 to prevent undesirable buildup of material in the area. For this purpose, and as shown in FIG. 2, the diameter of plate 27 is less than that of housing wall 2 and tube sheet 6 to provide an annular fluid flow passage around the edge of the plate so as to communicate between the outer face of plate 27 and the space between plate 27 and tube sheet 6. In addition, plate 27 is provided with a plurality of unobstructed fluid flow openings 38 between baskets 17 and the basket-receiving openings 33 for improved communication to the underside of the plate.

Although the drawings illustrate the aspects of the invention as applied to tube sheet 6, it is contemplated that the same construction would normally be utilized in connection with tube sheet 7.

Various modes of carrying out the invention are contemplated as being within the scope of the following claims particularly pointing out and distinctly claiming the subject matter which is regarded as the invention.

We claim:

1. In combination in a heat exchanger having a housing, and having a plurality of longitudinally extending fluid flow tubes disposed within said housing, and having tube sheets disposed within said housing and with said tube sheets having openings in communication with the ends of said tubes, and further having longitudinally extending baskets for receiving shuttling tube cleaning elements:

(a) a retaining plate fixedly disposed in spaced relationship to the outer face of a said tube sheet, (b) and means, including said retaining plate, mounting a said basket in fixed relationship to said tube sheet and to an end of a said tube.

2. The combination of claim 1 in which said basket mounting means includes means securing said basket against transverse shifting.

3. The combination of claim 2 in which:

(a) said basket has a portion extending at least between said plate and said tube sheet and into telescoping connection with said tube sheet opening, (b) and said plate includes an opening receiving said basket therein, (c) said securing means comprising a two-point basket support utilizing said telescoping connection and said plate opening.

4. The combination of claim 1 in which said basket mounting means includes means securing said basket in longitudinally fixed position.

5. The combination of claim 4 in which:

(a) said basket has a portion extending at least between said plate and said tube sheet opening, (b) said plate includes an opening receiving said basket therein, (c) and said securing means comprises a threaded connection between said plate opening and said basket.

6. The combination of claim 4 in which:

(a) said basket has a portion extending at least between said plate and said tube sheet opening, (b) said plate includes an opening receiving said basket therein, (c) and said securing means comprises spaced shoulders disposed on said basket portion for engaging said tube sheet and said plate.

7. The combination of claim 6 wherein said shoulders are provided on an annular spacer disposed on the inner end portion of said basket.

8. The combination of claim 1, 2 or 4 in which said basket has a tube cleaning element holding portion disposed longitudinally outwardly of said retaining plate.

9. The combination of claim 1 which includes means providing for fluid communication between the outer face of said retaining plate and the space between said plate and said tube sheet.

10. The combination of claim 9 wherein said retaining plate is of lesser diameter than said tube sheet to form an annular fluid flow passage forming said fluid communication providing means.

11. The combination of claim 9 or 10 which includes:

(a) a plurality of basket receiving openings disposed in said retaining plate, (b) and a plurality of unobstructed fluid flow openings disposed in said plate between said basket receiving openings, and with said fluid flow openings forming said fluid communication providing means.

* * * * *